US008579533B2

(12) United States Patent
Sasada et al.

(10) Patent No.: US 8,579,533 B2
(45) Date of Patent: Nov. 12, 2013

(54) CONTAINER FOR A VISCOUS COSMETIC

(75) Inventors: Kaori Sasada, Yokohama (JP); Naomi Shimamura, Yokohama (JP); Ken Taguchi, Yokohama (JP); Yuuki Ogura, Yokohama (JP)

(73) Assignee: Shiseido Co., Ltd., Tokyo (JP)

( * ) Notice: Subject to any disclaimer, the term of this patent is extended or adjusted under 35 U.S.C. 154(b) by 0 days.

(21) Appl. No.: 13/121,352

(22) PCT Filed: May 25, 2009

(86) PCT No.: PCT/JP2009/002285
§ 371 (c)(1),
(2), (4) Date: Mar. 28, 2011

(87) PCT Pub. No.: WO2010/038335
PCT Pub. Date: Apr. 8, 2010

(65) Prior Publication Data

US 2011/0176853 A1 Jul. 21, 2011

(30) Foreign Application Priority Data

Sep. 30, 2008 (JP) ..... 2008-254155

(51) Int. Cl.
*B05C 17/005* (2006.01)

(52) U.S. Cl.
USPC ..... 401/265; 401/171; 401/172; 401/173; 401/174; 401/175

(58) Field of Classification Search
USPC ..... 401/171–175, 265
See application file for complete search history.

(56) References Cited

U.S. PATENT DOCUMENTS

| | | | | |
|---|---|---|---|---|
| 3,825,021 | A * | 7/1974 | Seidler | 401/172 |
| 5,772,347 | A * | 6/1998 | Gueret | 401/263 |
| 6,746,170 | B2 * | 6/2004 | Delage | 401/266 |
| 7,309,185 | B2 * | 12/2007 | Thorpe et al. | 401/277 |
| 7,677,828 | B2 * | 3/2010 | Tani | 401/266 |
| 8,226,318 | B1 * | 7/2012 | Williams | 401/266 |
| 8,277,137 | B2 * | 10/2012 | Sawata | 401/265 |
| 8,282,303 | B2 * | 10/2012 | Umeno et al. | 401/265 |
| 2007/0251541 | A1 * | 11/2007 | Nasu et al. | 132/320 |
| 2009/0297252 | A1 * | 12/2009 | Prague | 401/265 |
| 2012/0219348 | A1 * | 8/2012 | Py et al. | 401/151 |

FOREIGN PATENT DOCUMENTS

| | | |
|---|---|---|
| JP | 2005-306856 | 11/2005 |
| JP | 2006-150098 | 6/2006 |
| JP | 2007-319392 | 12/2007 |
| WO | WO-2006/018907 | 2/2006 |

* cited by examiner

*Primary Examiner* — Gregory Huson
*Assistant Examiner* — Bradley Oliver
(74) *Attorney, Agent, or Firm* — Jordan and Hamburg LLP

(57) ABSTRACT

Provided is a container for a viscous cosmetic such that even when the viscous cosmetic makes contact with the applicator comprised of silicone resin there is little swelling of said applicator and the quality of the viscous cosmetic container is well maintained. An applicator made of silicone resin inside which is formed a flow-way which can communicate with a housing for internally housing a viscous cosmetic is connected to one end of the housing. A distributing port which communicates with the flow-way is formed in the applying-surface of the applicator and the viscous cosmetic within the housing can be discharged outward from the distributing port. The degree of swelling of the applicator produced by contact with the viscous cosmetic is set to from 0 wt % to 5.0 wt % by including from 50 to 100 wt % with respect to the whole of the fluid oil fraction of any one, or combination, of deodorized polybutene, isostearyl oxystearate, polyglyceryl tri-isostearate or macadamia nut oil for the fluid oil fraction of the viscous cosmetic.

4 Claims, 2 Drawing Sheets

CONTAINER FOR A VISCOUS COSMETIC

BACKGROUND OF THE INVENTION

The present invention relates to a container for a viscous cosmetic, with a housing for storing the viscous cosmetic and an applicator made of silicone resin connected to a tip of the housing.

Traditionally, there have been containers for a viscous cosmetic substance such as lip gloss that store the viscous cosmetic in a hollow-cylindrical or tube-like housing and comprise an applicator connected to a tip of the housing. At the applicator, a distribution port for discharging the viscous cosmetic is formed from which the viscous cosmetic within the housing can be discharged outward in small quantities while being applied to an application target area such as a lip.

Among such conventional containers for a viscous cosmetic, as shown in JP-2007-319392A, certain are known in which the applicator is formed from a silicone resin. By thus forming the applicator from silicone resin, a favorable sensation at a lip or other application target area being touched by the applicator can be achieved due to the soft elasticity of the silicone resin. Because silicone resin has a property of hardly deteriorating or otherwise altering under contact with air, such soft tactile sensation is not harmed, allowing a good product quality to be maintained.

SUMMARY OF THE INVENTION

However, it has become apparent that when silicone resin comes into contact with a fluid oil fraction contained in the viscous cosmetic, the fluid oil fraction penetrates the silicone resin and causes the silicone resin to swell. Therefore, when using an applicator made from silicone resin according to the invention that is disclosed in JP-2007-319392A, swelling of the applicator occurs due to the viscous cosmetic coming into contact with the applicator.

If the swelling is conspicuous, the dimensions of the applicator change, leading to inconveniences such as a lid failing to close or the discharge condition of the viscous cosmetic worsening due to constriction of the viscous cosmetic's flow-path formed within the applicator, while the amount of the fluid oil fraction contained in the viscous cosmetic is altered because only the fluid oil fraction infiltrates the applicator. In consequence, product quality is difficult to maintain at a favorable level.

The present invention is an attempt to resolve issues as those described above, such that even when a viscous cosmetic makes contact with a silicone-resin comprising applicator provided at a tip of the viscous cosmetic container, swelling of the applicator is enabled to be suppressed and the product quality of the viscous cosmetic container to be well maintained.

The invention, in order to solve the problems as defined above, provides a container for a viscous cosmetic wherein an applicator made of silicone resin inside which is formed a flow-path which can communicate with a hollow-cylindrical or tube-like housing for internally housing a viscous cosmetic is connected to one end of the housing. A distribution port, which communicates with the flow-path, is formed in the applying-surface of the applicator, such that the viscous cosmetic within the housing is dischargeable outward from the distribution port.

By thus forming the applicator of the viscous-cosmetic container from silicone resin, a good tactile sensation is enabled because the elasticity of the silicone resin enables softening the skin touch at the lips or other application target area, while product quality can be well maintained since deterioration under contact with air hardly occurs.

For the fluid oil fraction of the viscous cosmetic, any one or combination of several of deodorized polybutene, isostearyl oxystearate, polyglyceryl tri-isostearate, macadamia nut oil, glyceryl (hydrogenated rosin/isostearate), and pentaerythrityl tetra-(ethylhexanoate/benzoate), is included at 40~100 wt % of the total fluid oil fraction of the viscous cosmetic.

By including accordingly, as a fluid oil fraction of the viscous cosmetic, any one or combination of deodorized polybutene, isostearyl oxystearate, polyglyceryl tri-isostearate, macadamia nut oil, glyceryl (hydrogenated rosin/isostearate), and pentaerythrityl tetra-(ethylhexanoate/benzoate) at 40~100 wt % of the total fluid oil fraction of the viscous cosmetic, the swelling ratio of the applicator caused by contact with the viscous cosmetic can be set to 0 wt %~5.0 wt %.

That is, if the content in the viscous cosmetic is less than 50 wt % of the total fluid oil fraction, the swelling ratio of the applicator exceeds 5.0 wt %. Then, if the swelling ratio of the applicator exceeds 5.0 wt %, the dimensions of the applicator change, leading to inconveniences such as a lid failing to close or the flow-path of the viscous cosmetic formed within the applicator becoming constricted such that the discharge condition of the viscous cosmetic becomes bad. At the same time, because a portion of the fluid oil fraction of the viscous cosmetic is infiltrating into the applicator, depending on the type of the fluid oil fraction, a conspicuous change in the fluid oil fraction content may occur such that the prescription of the viscous cosmetic is altered. This makes it difficult to maintain a good quality of the product.

Among the fluid oil fractions includable in the viscous cosmetic, silicone resin infiltration experiments were carried out with each one of deodorized polybutene, isostearyl oxystearate, polyglyceryl tri-isostearate, macadamia nut oil, glyceryl (hydrogenated rosin/isostearate), and pentaerythrityl tetra-(ethylhexanoate/benzoate) as fluid oil fraction, wherein for every fluid oil fraction the swelling ratio of silicone resin was found to be below 5.0 wt %. Further, it was also confirmed by experiment that the swelling ratio of the applicator under contact with the viscous cosmetic can be set to 0 wt %~5.0 wt % by including the above fluid oil fractions at 40~100 wt % of the total fluid oil fraction contained in the viscous cosmetic.

By setting the swelling ratio of the applicator to 0 wt %~5.0 wt % as described above, even when the applicator makes contact with the viscous cosmetic, inconveniences such as the shape of the applicator changing or the content of the fluid oil fraction within the viscous cosmetic being significantly altered are less likely to occur, which enables to maintain a good quality of the product.

In addition, the viscous cosmetic may include petroleum jelly at 0~20 wt % as a semi-solid oil fraction. Although petroleum jelly is commonly used as a semi-solid oil fraction in conventional viscous cosmetics, with regard to silicone resin, bleaching of the silicone resin may occur when contacted by petroleum jelly. And so, when using a viscous cosmetic including more than 20% of added petroleum jelly, situations arise where the applicator is bleached when the viscous cosmetic and the applicator come into contact.

Therefore, if the applicator is formed of silicone resin with high transparency, for example, bleaching of the applicator is clearly recognized by eyesight when the applicator and the viscous cosmetic make contact. Thus, the outward appearance of the applicator turning white raises product quality issues. Hence in the present invention, when using petroleum jelly as a semi-solid oil fraction of the viscous cosmetic, as described above, setting the petroleum jelly content to 0~20 wt % enables to prevent bleaching of the applicator under contact with the viscous cosmetic. Thus, even if silicone resin of high transparency is used and at the same time petroleum jelly included in the viscous cosmetic, it becomes possible to keep the applicator transparent, with no change in the applicator's appearance occurring.

The applying-surface may be formed in an elliptical shape inclined relative to an axial direction of the applicator, simultaneously being formed protruding in an arc-shape. Forming the applying-surface in an inclined elliptical shape in this way enables easy positioning of the applying-surface, when the container for the viscous cosmetic is supported with the applying-surface turned upward, opposite an application target area such as a lip. From the protruding formation of the applying-surface, a small area of contact between the applying-surface and the application target area results such that the soft elasticity of the silicone-resin made applicator is easily conveyable to the application target area, enabling a favorable sense of being touched at the application target area during application.

The invention, constituted as described above, by including any one or combination of several of deodorized polybutene, isostearyl oxystearate, polyglyceryl tri-isostearate, macadamia nut oil, glyceryl (hydrogenated rosin/isostearate), and pentaerythrityl tetra-(ethylhexanoate/benzoate) as a fluid oil fraction at 40~100 wt % of the total fluid oil fraction of the viscous cosmetic, enables setting the ratio of swelling of the applicator caused by contact with the viscous cosmetic to 0 wt %~5.0 wt %, to suppress the swelling of the applicator. By setting the swelling ratio of the applicator to 0 wt %~5.0 wt % in this way, inconveniences caused by the applicator's dimensions changing, such as a lid failing to close or a flow-path of the viscous cosmetic formed within the applicator narrowing such that the discharge condition of the viscous cosmetic worsens, become unlikely to occur, while at the same time the contents prescription of the viscous cosmetic is enabled to be kept substantially constant without the fluid oil fraction content in the viscous cosmetic changing conspicuously. This enables to maintain a good quality of the product.

DETAILED DESCRIPTION OF THE INVENTION

Figure 1:
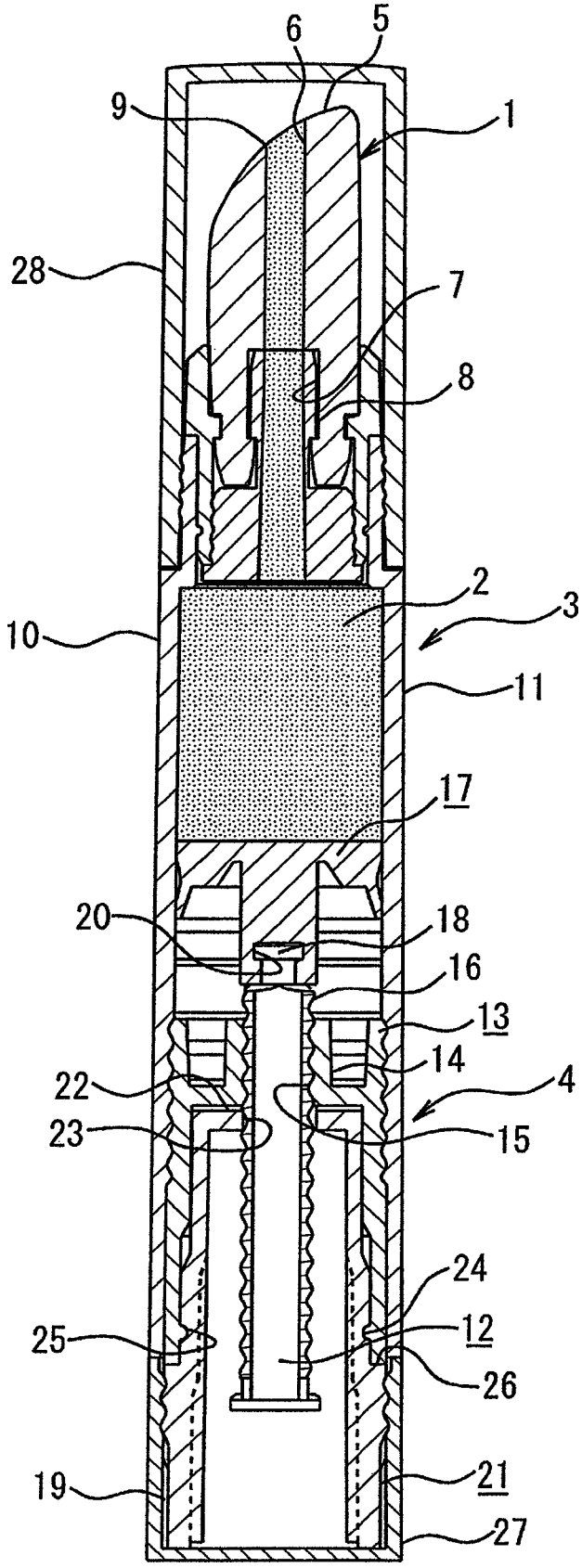
FIG. 1 is a cross-section of a container for a viscous cosmetic, according to Embodiments 1~6 of the invention.

To describe, based on FIG. 1, embodiments of the present invention, (1) is an applicator made of silicone resin, connected to the top of a housing (3) that houses a viscous cosmetic (2). The housing (3) is provided with an extrusion mechanism (4) for pressing the internally housed viscous cosmetic (2) into the direction of the applicator (1). To give in the following a detailed description of the container for a viscous cosmetic of the present embodiments, the applicator (1) comprises at its tip an elliptically shaped applying-surface (5), which is inclined with respect to an axial direction of the applicator (1). Forming the applying-surface (5) in this way enables easy positioning of the applying-surface (5) facing an application target area such as a lip when the container for the viscous cosmetic is supported with the applying-surface (5) turned upward.

In the embodiments, the applying-surface (5) is furthermore formed projecting outward in an arc-shape as shown in FIG. 1. By forming the applying-surface (5) protruding in this way, the contact area between the applying-surface (5) and the application target area is made small such that the soft elasticity of the applicator (1) made of silicone resin is easily conveyable to the application target area, enabling a favorable sense of touch at the application target area during application.

In addition, as shown in FIG. 1, a distribution port (9) for the viscous cosmetic (2) is formed at the center of the applying-surface (5). Further, in continuation of the distribution port (9), a flow-path (6) for the viscous cosmetic (2) is formed in the axial direction of the applicator (1). Then, at the bottom end of the applicator (1), a bottom fitting hole (7) is hollowed out in continuation of the flow-path (6). Although in the present embodiments the distribution port (9) and flow-path (6) are formed in one location of the applicator (1) only, in differing other embodiments the distribution port (9) and flow-path (6) may be formed in a plurality of locations in the applicator (1).

The applicator (1) formed as described above is connected to the top of the housing (3) by fitting a top fitting unit (8), which is provided in a protruding condition at the top of the housing (3), into the bottom fitting hole (7) of the housing (3), which is formed in the applicator (1) as described above. The housing (3) is formed with a hollow-cylindrical body (10), which in a central portion is provided with a housing main body (11) that internally houses the viscous cosmetic (2). On the side of the housing (3) opposite the side where the applicator (1) is connected, the extrusion mechanism (4) is provided for pressing the internally housed viscous cosmetic (2) toward the applicator (1).

The top fitting unit (8) of the accordingly formed housing (3) is formed in a cylindrical shape, and this top fitting unit (8) fitted into the bottom fitting hole (7) of the applicator (1). Thus, the housing main body (11) and the flow-path (6) in the applicator (1) are brought into communication, enabling the viscous cosmetic (2) in the housing main body (11) to be discharged via the flow-path (6) to the applying-surface (5).

Next, to describe in the following the extrusion mechanism (4) in detail, a holding member (13) of circular hollow-cylindrical shape is fixedly arranged on the bottom-side inner circumference of the housing (3). Further, a hollow-cylindrical holding section (14) is fixedly arranged by integral formation towards the interior of the holding member (13), with an internal thread (15) formed on an interior circumference of the holding section (14). An external thread (16) screw-threadedly engageable with the internal thread (15) of the holding section (14) is formed on an outer circumference of a rod-like rotary shaft (12) with a center plate (17) connected to an upper end thereof, the rotary shaft (12) being screw-threadedly received in the holding section (14).

Due to the rotary shaft (12) being screw-threadedly received in the holding section (14), which is fixedly arranged on the inner circumference of the hollow-cylindrical body (10), the rotary shaft (12) is positioned with respect to the housing (3) in axial direction toward its bottom end. Further, as shown in FIG. 1, protruding from the upper end of the rotary shaft (12) an engagement protrusion (18) is provided, while on the bottom face of the center plate (17) an engagement recess (20) is formed that is engageable to said engagement protrusion (18). The engagement protrusion (18) of the rotary shaft (12) is engaged to the engagement recess (20) of the center plate (17) in such a way that the rotary shaft (12) is rotatable independently of the center plate (17). Also, the rotary shaft (12) has an oval cross-sectional shape.

In addition, on an inner circumference of the holding member (13), an inner pipe (21) is arranged below the holding section (14). The inner pipe (21) is formed in a circular hollow-cylindrical shape having, as shown in FIG. 1, a ceiling panel (22) provided at the top, while the bottom end is provided with a protrusion portion (19) that protrudes outward beyond a lower edge of the hollow-cylindrical body (10). Furthermore, the ceiling panel (22) is provided with an insertion hole (23) at its center for inserting the rotary shaft (12).

This insertion hole (23) has an elliptical shape matched to the cross-sectional shape of the rotary shaft (12) and is formed somewhat larger than the outside diameter of the rotary shaft (12). Since the insertion hole (23) is formed in this way, inserting the rotary shaft (12) into the insertion hole (23) enables the rotary shaft (12) to rotate unitedly with the inner pipe (21), and to slide in up-down direction independently of the inner pipe (21).

Furthermore, an annular engagement groove (24) is formed in the outer circumference of the inner pipe (21), and an annular projection (25) engageable with the engagement groove (24) provided in a projecting manner on the inner circumference at the lower end of the holding member (13). By engaging the annular projection (25) of the holding member (13) with the engagement groove (24) of the inner pipe (21), the inner pipe (21) is assembled non-withdrawable from the holding member (13) and rotatable independently the holding member (13).

In addition, below the engagement groove (24) an abutment step portion (26) is provided, the bottom surface of the holding member (13) being arranged abutting said abutment step portion (26). Furthermore, on the outer circumference of the protrusion portion (19) of the inner pipe (21), a rotary body (27) with circular hollow-cylindrical form and U-like cross-sectional shape is fixedly connected to the protrusion portion (19), a top surface of the rotary body (27) abutting a bottom surface of the hollow-cylindrical body (10).

Also, a lid (28) of circular hollow-cylindrical shape that enables the applicator (1) to be covered is detachably connected to the top of the hollow-cylindrical body (10). When not in use, the applicator (1) can be covered by connecting the lid (28) to the upper end of the housing (3), thus cutting off contact with the outside air. This enables to avoid degeneration of the viscous cosmetic (2) due to contact with the outside air, and also to prevent contamination of the applicator (1) and the viscous cosmetic (2) due to dust and dirt in the environment adhering to the applicator (1).

As constituted by the above, the mechanism for discharging the viscous cosmetic (2) will be described in detail below. First, the viscous cosmetic (2) is filled into the housing main body (11). Incidentally, the prescription of the viscous cosmetic (2) will be described in detail further below. Then, the lid (28) connected to the hollow-cylindrical body (10) is removed, and while the housing (3) is gripped by hand for fixation, the rotary body (27) provided at the lower end of the housing (3) is rotated in one direction. From this, also the inner pipe (21) to which the rotary body (27) is fixed rotates in the same direction in unity with the rotary body (27). Thus, the rotary shaft (12) inserted into the insertion hole (23) of the inner pipe (21) rotates together with the inner pipe (21) and, due to the internal thread (15) of the holding section (14), is pushed toward the applicator (1).

Due to this movement of the rotary shaft (12) toward the applicator (1), the center plate (17) connected to the upper end of the rotary shaft (12) is pressed into the direction of the applicator (1), causing the center plate (17) to move slidingly within the housing (3) toward the applicator (1). Because the rotary shaft (12) is assembled to be rotatable independently of the center plate (17) as described above, the center plate (17) moves slidingly in a non-rotating manner within the housing in the direction of the applicator (1). Due to the sliding motion of the center plate (17) toward the applicator (1), the viscous cosmetic (2) in the housing main body (11) is pressed into the direction of the applicator (1). This causes the viscous cosmetic (2) in the housing main body (11) to be fed via the top fitting unit (8) into the flow-path (6) in the applicator (1).

The viscous cosmetic (2), having passed through the flow-path (6) in the applicator (1) while being pressed by the center plate (17) as described above, is discharged from the distribution port (9) on the applying-surface (5) to the outside. This enables to discharge a desired amount of the viscous cosmetic (2) from the distribution port (9) by suitably turning the rotary body (27), in order to apply the viscous cosmetic (2) to an application target area.

Here, when the viscous cosmetic (2) passes through the flow-path (6) in the applicator (1), when applying-work is carried out after the viscous cosmetic (2) has been discharged onto the applying-surface and in similar such cases, the viscous cosmetic (2) and the applicator (1) come into contact. Therefore, depending on the prescription of the viscous cosmetic (2), a problem of the applicator (1) swelling due to contact with the applicator (1) arises.

That is, if the swelling ratio of the applicator (1) due to contact with the viscous cosmetic (2) exceeds 5.0 wt %, changing dimensions of the applicator (1) lead to inconveniences such as the lid (28) failing to close or the flow-path of the viscous cosmetic (2) formed within the applicator (1) becoming constricted, causing the discharge condition of the viscous cosmetic (2) to become bad.

Also, because a portion of the fluid oil fraction in the viscous cosmetic (2) is infiltrating the applicator (1), depending on the type of the fluid oil fraction, there are cases where a conspicuous change in the fluid oil fraction content occurs such that the prescription of the viscous cosmetic is altered. This is why the present invention, by setting the swelling ratio of the applicator to 0 wt %~5.0 wt %, aims at obtaining a container for a viscous cosmetic wherein inconveniences such as dimensional changes of the applicator (1) or worsening of the discharge condition of the viscous cosmetic (2) are difficult to occur.

Yet, since the swelling of the applicator (1) occurs due to a fluid oil fraction in the viscous cosmetic (2) penetrating the applicator (1), the swelling ratio of the applicator (1) differs depending on the type of fluid oil fraction. Therefore, using the principal fluid oil fractions most commonly employed in viscous cosmetics (2), the swelling ratio of the applicator (1) in each case of impregnating the applicator (1) with one of the fluid oil fractions was measured.

The method of measuring the swelling ratio is described as follows. First, 2×2×0.5 cm specimens were prepared of the silicone resin that is employed for the applicator (1) of the present embodiments, and the mass of the specimens weighed. Then, specimens were immersed in each fluid oil fraction, and left to stand for one week under an atmosphere of 50° C. Then, the specimens were taken out and, the fluid oil fraction adhering to each specimen was wiped off, and the specimen weighed. From the weight before immersion and the weight after immersion, the swelling ratio was calculated. Measurement results of the swelling ratio for each fluid oil fraction are shown in FIG. 2.

Figure 2:
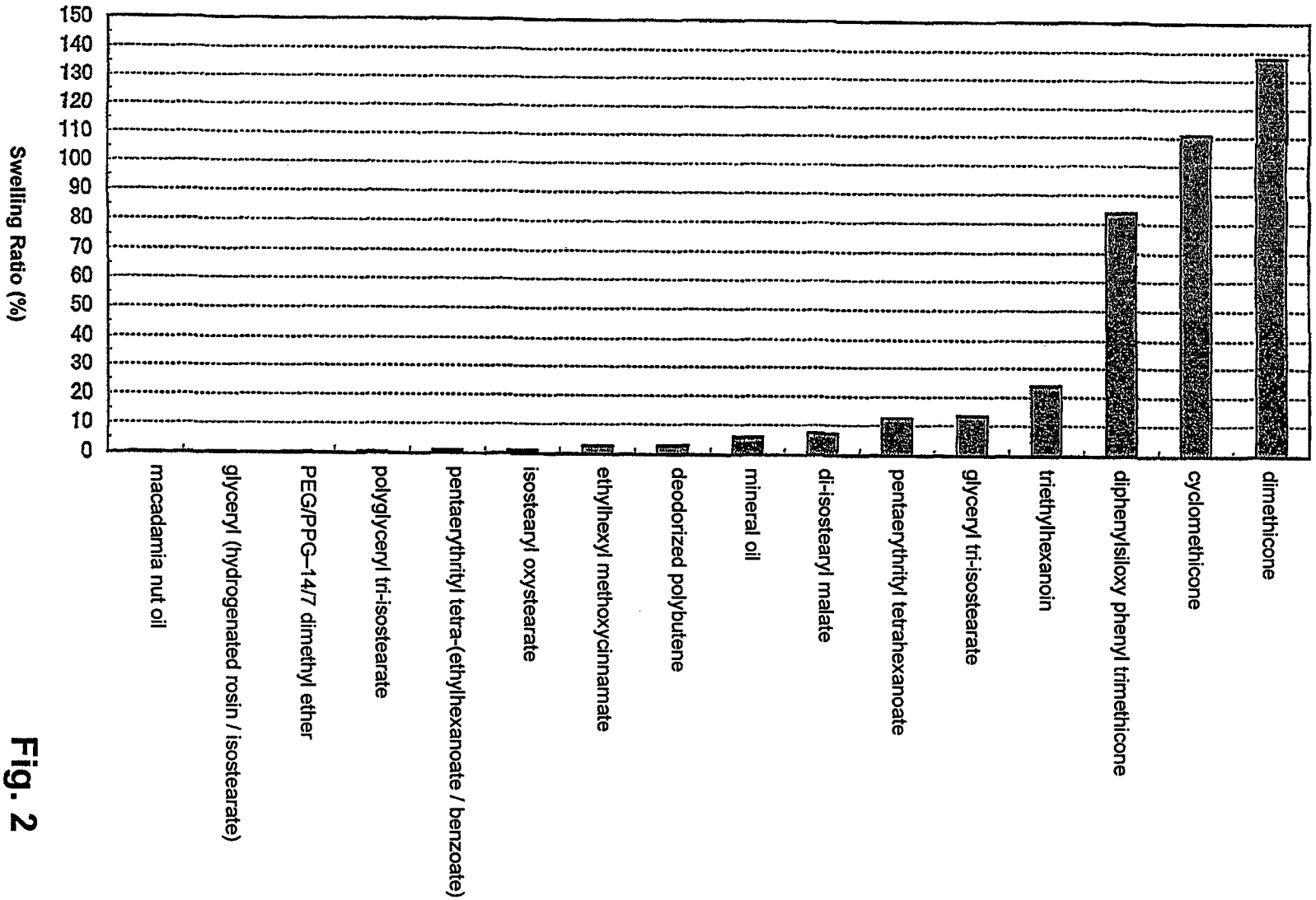
FIG. 2 is a graph showing the swelling ratio of a specimen when immersed in various fluid oil fractions.

As shown in FIG. 2, for deodorized polybutene, isostearyl oxystearate, polyglyceryl tri-isostearate, macadamia nut oil, glyceryl (hydrogenated rosin/isostearate), and pentaerythrityl tetra-(ethylhexanoate/benzoate), the swelling ratio was 5.0 wt % or less. On the other hand, for any one of mineral oil, di-isostearyl malate, glyceryl tri-isostearate, and pentaerythrityl tetrahexanoate, the swelling ratio exceeded 5.0 wt %.

Given these results, in the embodiments of the invention as shown in Table 1 below, deodorized polybutene, isostearyl oxystearate, polyglyceryl tri-isostearate, macadamia nut oil, glyceryl (hydrogenated rosin/isostearate), and pentaerythrityl tetra-(ethylhexanoate/benzoate), were determined for use as fluid oil fraction. The individual ingredients of the viscous cosmetic (2) in the embodiments of the invention are given in Table 1 below. The "specified fluid oil fraction" in Table 1 signifies, among fluid oil fractions, any one of or combination of deodorized polybutene, isostearyl oxystearate, polyglyceryl tri-isostearate, macadamia nut oil, glyceryl (hydrogenated rosin/isostearate), and pentaerythrityl tetra-(ethylhexanoate/benzoate).

The specified fluid oil fraction among the total fluid oil fraction included in the viscous cosmetic (2) was set to 100 wt % in Embodiment 1~4, to 67 wt % in Embodiment 5, and to 43 wt % in Embodiment 6. In contrast, for comparative examples to the embodiments, the specific fluid oil fraction among the total fluid oil fraction was set to 7.6 wt %, 9.8 wt %, and 29.4 wt % in Comparative examples 1~3, respectively. The swelling ratio of the applicator (1) upon immersion in the accordingly prescribed viscous cosmetic (2) of Embodiments 1~5 and Comparative examples 1~3 was measured in the same way as during the measurement of the swelling ratio of the applicator (1) specimens upon immersion in the individual fluid oil fractions.

TABLE 1

(wt %)

| Name of Ingredient | | | Embodiment 1 | Embodiment 2 | Embodiment 3 | Embodiment 4 | Embodiment 5 |
|---|---|---|---|---|---|---|---|
| dextrin palmitate | | | 2.5 | 2.5 | 2.5 | 2.5 | 2.5 |
| microcrystalline wax | | | — | 1 | 1 | 1 | — |
| silylated silica | | | 3.5 | 3.5 | 3.5 | 3.5 | 3 |
| Semi-solid oil fraction | (phytosteryl/behenyl) dimer dilinoleate | | — | — | — | — | 5 |
| | petroleum jelly | | — | 15 | 15 | 15 | 14 |
| | pentaerythritol tetra-(behenate/benzoate/ethylhexanoate) | | — | — | — | — | — |
| Fluid oil fraction | Specified fluid oil fraction | deodorized polybutene | 40 | 30 | 20 | 20 | 40 |
| | | polyglyceryl tri-isostearate | 40 | 40 | 40 | 40 | — |
| | | isostearyl oxystearate | 12 | 6 | 16 | — | — |
| | | macadamia nut oil | — | — | — | 16 | — |
| | | glyceryl (hydrogenated rosin/isostearate) | — | — | — | — | 9 |
| | | pentaerythrityl tetra-(ethylhexanoate/benzoate) | — | — | — | — | — |
| | glyceryl tri-isostearate | | — | — | — | — | — |
| | mineral oil | | — | — | — | — | — |
| | pentaerythrityl tetrahexanoate | | — | — | — | — | — |
| | di-isostearyl malate | | — | — | — | — | 24.5 |
| red dye # 202 | | | 2 | 2 | 2 | 2 | 2 |
| Total | | | 100 | 100 | 100 | 100 | 100 |
| specified fluid oil fraction/total fluid oil fraction | | | 100 | 100 | 100 | 100 | 67 |
| Mass swelling ratio (wt %) | | | 2.4 | 2.4 | 1.9 | 2.1 | 5.0 |

(wt %)

| Name of Ingredient | | | Embodiment 6 | Comparative Example 1 | Comparative Example 2 | Comparative Example 3 |
|---|---|---|---|---|---|---|
| dextrin palmitate | | | 5 | 2.5 | 2.5 | 2.5 |
| microcrystalline wax | | | — | 1 | 1 | 1 |
| silylated silica | | | — | 3.5 | 3.5 | 3.5 |
| Semi-solid oil fraction | (phytosteryl/behenyl) dimer dilinoleate | | — | 5 | — | — |
| | petroleum jelly | | — | 10 | 40 | 40 |
| | pentaerythritol tetra-(behenate/benzoate/ethylhexanoate) | | — | 10 | — | — |
| Fluid oil fraction | Specified fluid oil fraction | deodorized polybutene | — | 5 | 5 | 15 |
| | | polyglyceryl tri-isostearate | — | — | — | — |
| | | isostearyl oxystearate | — | — | — | — |
| | | macadamia nut oil | — | — | — | — |
| | | glyceryl (hydrogenated rosin/isostearate) | — | — | — | — |
| | | pentaerythrityl tetra-(ethylhexanoate/benzoate) | 40 | — | — | — |
| | glyceryl tri-isostearate | | — | 20 | 20 | 20 |
| | mineral oil | | — | 11 | 26 | 16 |
| | pentaerythrityl tetrahexanoate | | 10 | — | — | — |
| | di-isostearyl malate | | 43 | 30 | — | — |
| red dye # 202 | | | 2 | 2 | 2 | 2 |
| Total | | | 100 | 100 | 100 | 100 |
| specified fluid oil fraction/total fluid oil fraction | | | 43 | 8 | 10 | 29 |
| Mass swelling ratio (wt %) | | | 2.1 | 6.8 | 6.6 | 7.2 |

In the results, as shown in Table 1, the swelling ratio of the applicator (1) when using the viscous cosmetic (2) of Embodiments 1~6 was 2.4 wt % in Embodiments 1 and 2, 1.9 wt % in Embodiment 3, 2.1 wt % in Embodiment 4, 5.0 wt % in Embodiment 5, and 2.1 wt % in Embodiment 6, respectively. On the other hand, it was 6.8 wt % in Comparative example 1, 6.6 wt % in Comparative example 2, and 7.2 wt % in Comparative example 3.

The above results confirm that in case of the specified fluid oil fraction within the total fluid oil fraction being set to 43 wt %, 67 wt %, or 100 wt %, it is possible to restrain the swelling ratio caused by contact between the viscous cosmetic (2) and the applicator (1) to 5 wt % and less. Thus, by using the viscous cosmetic (2) of Embodiments 1~6, it becomes possible to prevent deformation due to swelling of the applicator (1), changes of the fluid oil fraction content and the like, such that the product quality is enabled to be well maintained.

On the other hand, in Comparative examples 1~3 the swelling ratio of the applicator (1) was higher than 5.0 wt %, such that changes in the dimensions of the applicator (1) will lead to inconveniences such as the lid (28) failing to close or the flow-path of the viscous cosmetic (2) formed within the applicator (1) becoming constricted, causing the discharge condition of the viscous cosmetic (2) to become unfavorable. Also, because a portion of the fluid oil fraction in the viscous cosmetic (2) penetrates the applicator (1), depending on the type of the fluid oil fraction, there will be cases where a conspicuous change in the fluid oil fraction content occurs such that the prescription of the viscous cosmetic is altered.

As shown in Table 1, Embodiments 2~5 of the invention furthermore include petroleum jelly, which is in general use conventionally as a semi-solid oil fraction. However, when silicone resin comes into contact with petroleum jelly, there are cases where the petroleum jelly penetrates into the silicone resin, causing the silicone resin to bleach.

Therefore, experiments were performed concerning the bleaching of the applicator (1) upon immersion in petroleum jelly. To describe these bleaching experiments in the following, initially, oil fractions were prepared by adding petroleum jelly to mineral oil in respective proportions of 14 wt %, 20 wt %, 30 wt %, 40 wt %, 50 wt %, and 100 wt %. Then, specimens of the applicator (1) cut to 2×2×0.5 cm were immersed in each of the oil fractions. After subsequently resting for one week at 50° C. each specimen was taken out and wiped clean of the oil fraction, in order to ascertain the color change of each specimen by eyesight. The results of these bleaching experiments are shown in Table 2.

TABLE 2

| Petroleum jelly admixture amount (wt %) | Appearance |
|---|---|
| 100 | whitish |
| 50 | whitish |
| 40 | slightly whitish |
| 30 | slightly whitish |
| 20 | no change |
| 14 | no change |

As shown in Table 2, when the specimen was immersed in an oil fraction with a petroleum jelly admixture ratio of 14 wt % or 20 wt %, there was no change in the color of the specimen, and no bleaching was acknowledged. On the other hand, when immersed in an oil fraction with a petroleum jelly admixture ratio of 30 wt %, 40 wt %, 50 wt %, or 100 wt %, the applicator (1) was found to have changed to a whitish or slightly whitish appearance after the immersion.

Based on the above results, for Embodiments 2~4 petroleum jelly was included in the viscous cosmetic (2) at 15 wt %, and for Embodiment 5 at 14 wt %, i.e. at not more than 20 wt %. Therefore, even if the viscous cosmetic (2) of Embodiments 2~5 makes contact with the applicator (1), bleaching of the applicator (1) due to contact with the viscous cosmetic (2) is enabled to be suppressed, such that maintaining a good product quality is enabled, without causing the appearance of the applicator (1) to change.

Incidentally, although in the embodiments as described above the housing (3) is formed with a hollow-cylindrical shape internally provided with the extrusion mechanism (4), in differing other embodiments the housing (3) may be formed in a tube-like shape without an extrusion mechanism (4) being arranged as in the present embodiments. Forming the housing (3) in a tube-like shape in this way enables the viscous cosmetic (2) to be easily discharged by pressure from the fingers of the hand without an extrusion mechanism (4) being necessary. This enables a simple configuration with which an easily manufacturable, low-cost product is obtainable.

The invention claimed is:

1. A viscous-cosmetic container, comprising:

a tube-like or hollow-cylindrical housing internally housing a viscous cosmetic;

an applicator made of a silicone resin, connected to an end of the housing and in which is formed a flow-path communicating with the housing, the applicator having an applying-surface; and a distribution port, which communicates with the flow-path, formed in the applying-surface of the applicator, such that the viscous cosmetic within the housing can be discharged outward from the distribution port, wherein the viscous cosmetic comprises at least one of deodorized polybutene, isostearyl oxystearate, polyglyceryl tri-isostearate, macadamia nut oil, glyceryl (hydrogenated rosin/isostearate), and pentaerythrityl tetra-(ethylhexanoate/benzoate) as a fluid oil fraction at 40~100 wt % of the total fluid oil fraction of the viscous cosmetic so as to yield a swelling ratio of the silicone resin applicator of 0~5 wt % of the applicator, and wherein the viscous cosmetic includes 14~20 wt % of petroleum jelly as a semi-solid oil fraction.

2. The viscous-cosmetic container according to claim 1, wherein the applying-surface is formed in an elliptical shape inclined relative to an axial direction of the applicator, and is formed protruding in an arc-shape.

3. A viscous-cosmetic container, consisting of:

a tube-like or hollow-cylindrical housing internally housing a viscous cosmetic;

an applicator made of a silicone resin, connected to an end of the housing and in which is formed a flow-path communicating with the housing, the applicator having an applying-surface; and a distribution port, which communicates with the flow-path, formed in the applying-surface of the applicator, such that the viscous cosmetic within the housing can be discharged outward from the distribution port, wherein the viscous cosmetic comprises 14~20 wt % of petroleum jelly as a semi-solid oil fraction and at least one of deodorized polybutene, isostearyl oxystearate, polyglyceryl tri-isostearate, macadamia nut oil, glyceryl (hydrogenated rosin/isostearate), and pentaerythrityl tetra-(ethylhexanoate/benzoate) as a fluid oil fraction at 43~100 wt % of the total fluid oil fraction of the viscous cosmetic so as to yield a swelling ratio of the silicone resin applicator of 0~5 wt % of the applicator.

4. The viscous-cosmetic container according to claim 3, wherein the applying-surface is formed in an elliptical shape inclined relative to an axial direction of the applicator, and is formed protruding in an arc-shape.

* * * * *